US011198168B2

(12) United States Patent
Tsuchiya et al.

(10) Patent No.: US 11,198,168 B2
(45) Date of Patent: Dec. 14, 2021

(54) BENDING METHOD AND APPARATUS FOR THE SAME

(71) Applicant: HONDA MOTOR CO., LTD., Tokyo (JP)

(72) Inventors: Makoto Tsuchiya, Tochigi-ken (JP); Naoki Inoue, Tochigi-ken (JP); Toshifumi Matsuda, Tochigi-ken (JP); Masahiro Koike, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 410 days.

(21) Appl. No.: 16/246,600

(22) Filed: Jan. 14, 2019

(65) Prior Publication Data

US 2019/0217364 A1 Jul. 18, 2019

(30) Foreign Application Priority Data

Jan. 16, 2018 (JP) ..... JP2018-004714

(51) Int. Cl.
*B21D 22/24* (2006.01)
*B21D 11/18* (2006.01)
(Continued)

(52) U.S. Cl.
CPC ..... *B21D 22/24* (2013.01); *B21D 11/18* (2013.01); *B21D 19/084* (2013.01); *B21D 22/06* (2013.01); *B21D 37/12* (2013.01)

(58) Field of Classification Search
CPC ..... B21D 19/043; B21D 19/06; B21D 19/08; B21D 19/082; B21D 19/084; B21D 19/086; B21D 19/10; B21D 22/00; B21D 22/02; B21D 22/06; B21D 22/10; B21D 22/20; B21D 22/22; B21D 22/24; B21D 22/26; B21D 24/00; B21D 24/10; B21D 24/12;
(Continued)

(56) References Cited

U.S. PATENT DOCUMENTS 5,231,907 A * 8/1993 Matsuoka ..... B21D 28/325 83/588
7,654,124 B2 * 2/2010 Knaup ..... B21D 24/04 72/296
2008/0053184 A1 3/2008 Knaup

FOREIGN PATENT DOCUMENTS

JP 53-044634 4/1978
JP S-5344634 U * 4/1978
(Continued)

OTHER PUBLICATIONS

Translation—Takizawa—JPS-5344634-U, Translated Apr. 20, 2021 (Year: 1978).*
(Continued)

*Primary Examiner* — Debra M Sullivan
*Assistant Examiner* — Matthew Kresse
(74) *Attorney, Agent, or Firm* — Amin, Turocy & Watson, LLP

(57) ABSTRACT

A first-face forming portion of a workpiece and a second-face forming portion spaced apart from it by the length of an intermediate portion are clamped with a first-face forming die and a second-face forming die, respectively. The first-face forming die is moved either upward or downward and the second-face forming die is moved in a direction toward the first-face forming die, and the second-face forming die is pressed against the first-face forming die to shape the upright wall portion.

16 Claims, 10 Drawing Sheets

(51) Int. Cl.
*B21D 37/12* (2006.01)
*B21D 22/06* (2006.01)
*B21D 19/08* (2006.01)

(58) Field of Classification Search
CPC ..... B21D 24/14; B21D 11/00; B21D 11/18; B21D 11/20; B21D 11/22; B21D 37/08; B21D 37/10; B21D 37/12; B21D 28/325; B26D 5/16
USPC ..... 72/452.8, 452.9
See application file for complete search history.

(56) References Cited

FOREIGN PATENT DOCUMENTS

| | | | | |
|---|---|---|---|---|
| JP | 59-068612 | | | 5/1984 |
| JP | 02-280918 | | | 11/1990 |
| JP | 02280918 | A | * | 11/1990 |
| JP | 06-015825 | | | 3/1994 |
| JP | 2001-314918 | | | 11/2001 |
| JP | 2003-211231 | | | 7/2003 |
| JP | 2006-320941 | | | 11/2006 |
| JP | 4608529 | | | 3/2008 |
| JP | 2014-195829 | | | 10/2014 |

OTHER PUBLICATIONS

Japanese Office Action for Japanese Patent Application No. 2018-004714 dated Nov. 5, 2019.

* cited by examiner

EARLY STAGE OF SHAPING

MIDDLE STAGE OF SHAPING

LATE STAGE OF SHAPING

EARLY STAGE OF SHAPING

MIDDLE STAGE OF SHAPING

LATE STAGE OF SHAPING

BENDING METHOD AND APPARATUS FOR THE SAME

CROSS-REFERENCE TO RELATED APPLICATION

This application is based upon and claims the benefit of priority from Japanese Patent Application No. 2018-004714 filed on Jan. 16, 2018, the contents of which are incorporated herein by reference.

BACKGROUND OF THE INVENTION

Field of the Invention

The present invention relates to a bending method and a bending apparatus for performing bending by pressing a die against a plate-shaped workpiece.

Description of the Related Art

Steel plates subjected to press forming as automobile components are shaped into complicated cross-section shapes having various bent portions, some of which include a stepped cross-section structure with flat upper and lower surfaces being continuous via a upright wall portion, such as a so-called hat shape.

For shaping into such a hat shape, various forming means such as draw forming (also known as drawing or deep drawing) and form molding are conventionally used (see Japanese Patent No. 4608529).

SUMMARY OF THE INVENTION

In recent years, high-tensile strength steel plates have been increasingly used for automobile components in order to enable reduction in vehicle body weight. However, bending a workpiece made of high-strength material, such as a high-tensile strength steel plate, into a hat shape by the conventional draw forming or form molding leads to an issue such as outward warping of the upright wall portion after shaping.

The present invention has been made in view of this challenge and an object thereof is to provide a bending method and a bending apparatus that can restrain the upright wall portion from becoming warped during shaping of a workpiece having a cross-section structure with two flat faces being continuous via the upright wall portion.

To attain the object, the present invention provides a bending method for bending a plate-shaped workpiece using dies to shape the workpiece into a stepped cross-section structure with a first face and a second face connected via an upright wall portion. The bending method includes: a step of preparing the workpiece; a workpiece holding step of clamping a first-face forming portion of the workpiece and a second-face forming portion spaced apart from the first-face forming portion by a length of the upright wall portion with a first-face forming die and a second-face forming die, respectively; and a shaping step of moving the first-face forming die in a first direction perpendicular to a principal surface of the plate-shaped workpiece and moving the second-face forming die in a second direction parallel with the principal surface of the workpiece, and pressing the second-face forming die against the first-face forming die to shape the upright wall portion.

With this method, the upright wall portion is suspended off the first-face forming die and the second-face forming die during the movement of the first-face forming die and the second-face forming die, which can restrain bending and/or ironing from being applied to the upright wall portion. This can reduce residual stress in the upright wall portion and prevent warping of the upright wall portion.

In the bending method, in an early stage of the shaping step, a movement speed of the second-face forming die in the second direction may be lower than a movement speed of the first-face forming die in the first direction, and in a late stage of the shaping step, the movement speed of the second-face forming die in the second direction may be higher than the movement speed of the first-face forming die in the first direction. When this method is employed, an excess that occurs in the workpiece during movement of the second-face forming die in the second direction can be reduced and the drawback of the workpiece becoming corrugated during shaping can be prevented. As a result, wrinkles and/or strain around the upright wall portion can be prevented.

In the bending method, the movement speed of the second-face forming die in the shaping step may be gradually increased. Also in the bending method, the movement speed of the second-face forming die in the shaping step may be increased stepwise. These methods can also reduce an excess that occurs in the workpiece during movement of the second-face forming die in the second direction and prevent wrinkles and/or strain around the upright wall portion.

In the shaping step, a position of an end of the upright wall portion on the first-face side in a cross section of the workpiece may move along an arc centered at an end of the upright wall portion on the second-face side and having a radius equal to the length of the upright wall portion, when viewed with a position of the end on the second-face side being a reference. This method is effective for preventing wrinkles and/or strain around the upright wall portion because no excess occurs in the upright wall portion when the second-face forming die moves in the second direction.

In the shaping step, a position of an end of the upright wall portion on the first-face side in a cross section of the workpiece may move on a path that connects one or more in-between points set on an arc centered at an end of the upright wall portion on the second-face side and having a radius equal to the length of the upright wall portion with a line segment, when viewed with a position of the end on the second-face side being a reference. Such a method is also effective for restraining strain around the upright wall portion since only a slight excess occurs in the upright wall portion when the second-face forming die moves in the second direction. Additionally, a cam mechanism that makes planar contact can be used for driving of the second-face forming die, allowing bending to be done with a cam mechanism having little trouble associated with abrasion.

The bending method may further include a die opening step of opening the first-face forming die and the second-face forming die and removing the workpiece. In the die opening step, the first-face forming die may be opened before a position of the second-face forming die is returned. By employing this die opening step, the workpiece after the shaping step can be removed without deformation.

To attain the above object, the present invention also provides a bending apparatus for bending a plate-shaped workpiece using dies to shape the workpiece into a stepped cross-section structure with a first face and a second face connected via an upright wall portion. The bending apparatus includes: a first-face forming die to clamp a first-face forming portion of the workpiece; a second-face forming die to clamp a second-face forming portion spaced apart from the first-face forming portion by a length of the upright wall portion; a first driving unit for moving the first-face forming die in a first direction perpendicular to a principal surface of the plate-shaped workpiece; and a second driving unit for moving the second-face forming die in a second direction parallel with the principal surface of the workpiece to press the second-face forming die against the first-face forming die.

With this bending apparatus, the upright wall portion is suspended off the first-face forming die and the second-face forming die during movement of the first-face forming die and the second-face forming die, which can restrain bending and/or ironing from being applied to the upright wall portion. This can reduce residual stress in the upright wall portion and prevent warping of the upright wall portion.

In the bending apparatus, the second driving unit may have an interlock mechanism for driving the second-face forming die in the second direction by means of driving force that moves the first-face forming die in the first direction. In this case, the interlock mechanism may have a cam driver for transmitting pressure in the first direction and a cam face formed on the second-face forming die and making sliding contact with the cam driver, and may produce displacement in the second direction upon pressing by the cam driver. This arrangement allows the second driving unit to be embodied with a cam mechanism of the simplest structure. That is, a second driving unit that produces displacement in the second direction only with pressing in the first direction can be embodied and a pressing device common with the first-face forming die can be used for the second-face forming die.

In the bending apparatus, the cam face of the second-face forming die may be a curved surface, and a gradient of the cam face in a portion in contact with the cam driver in an early stage of shaping may be larger than a gradient of the cam face in a portion in contact with the cam driver in a late stage of shaping. This arrangement can make the movement speed of the second-face forming die low in an early stage of pressing and increased in a late stage of pressing, thus preventing sagging of the upright wall portion during the shaping of the workpiece. As a result, strain around the upright wall portion can be prevented.

In the bending apparatus, the cam face of the second-face forming die may have a plurality of inclined surfaces with different gradients, and the gradient of an inclined surface in contact with the cam driver in an early stage of shaping may be larger than the gradient of an inclined surface in contact with the cam driver in a late stage of shaping. In this case, the cam driver may have cam faces as many as a number of the inclined surfaces of the cam face, and the cam faces of the cam driver may make planar contact with the cam faces of the second-face forming die. With this arrangement, abrasion is less likely to occur because the cam faces of the cam driver make planar contact with the cam faces of the second-face forming die, so that a bending apparatus less prone to failure and having high reliability can be embodied.

As the first driving unit, a first elastic mechanism which is positioned adjacent the first-face forming die in the first direction and elastically compresses in the first direction upon pressing by the first driving unit may be provided. This arrangement allows the first-face forming die to be displaced in the first direction with a simple device configuration.

The bending apparatus may further include a second elastic mechanism that is mounted on the second-face forming die and elastically compresses in the first direction to inhibit displacement of the second-face forming die in the first direction. With this arrangement, displacement of a press working machine caused by the displacement of the first-face forming die can be absorbed by the second elastic mechanism, so that the first-face forming die and the second-face forming die can be pressed with a common pressing device.

The bending apparatus may further include a pushback mechanism for returning the second-face forming die to an initial position. This arrangement enables autonomous return of the second-face forming die and can provide a bending apparatus with high productivity.

In the bending apparatus, the first-face forming die may be composed of a upper die to be displaced integrally with the first driving unit, a lower die to be pressed by the upper die, and a first gas cushion which supports the lower die and elastically compresses upon pressing by the first driving unit; the second-face forming die may be composed of an upper slider for transmitting load from the first driving unit, a lower slider opposed to the upper slider, and a second gas cushion which biases the lower slider on the second direction side in a direction opposite to the second direction, is elastically compressed by movement of the lower slider in the second direction, and includes a locking mechanism capable of maintaining a compressed state of the second gas cushion; and the second gas cushion may maintain the compressed state when the first driving unit is lifted to separate the upper die of the first-face forming die from the workpiece.

This can prevent the disadvantage of unintended application of bending to the upright wall portion, which is caused by the second-face forming die moving in a direction away from the first-face forming die with the workpiece still clamped by the first-face forming die in the die opening step.

The bending method and the bending apparatus according to the present invention can restrain the upright wall portion from becoming warped during shaping of a workpiece having a cross-section structure with two flat surfaces being continuous via an upright wall portion.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

The bending method and the bending apparatus according to the present invention are described below by showing preferred embodiments with reference to the accompanying drawings.

Figure 1:
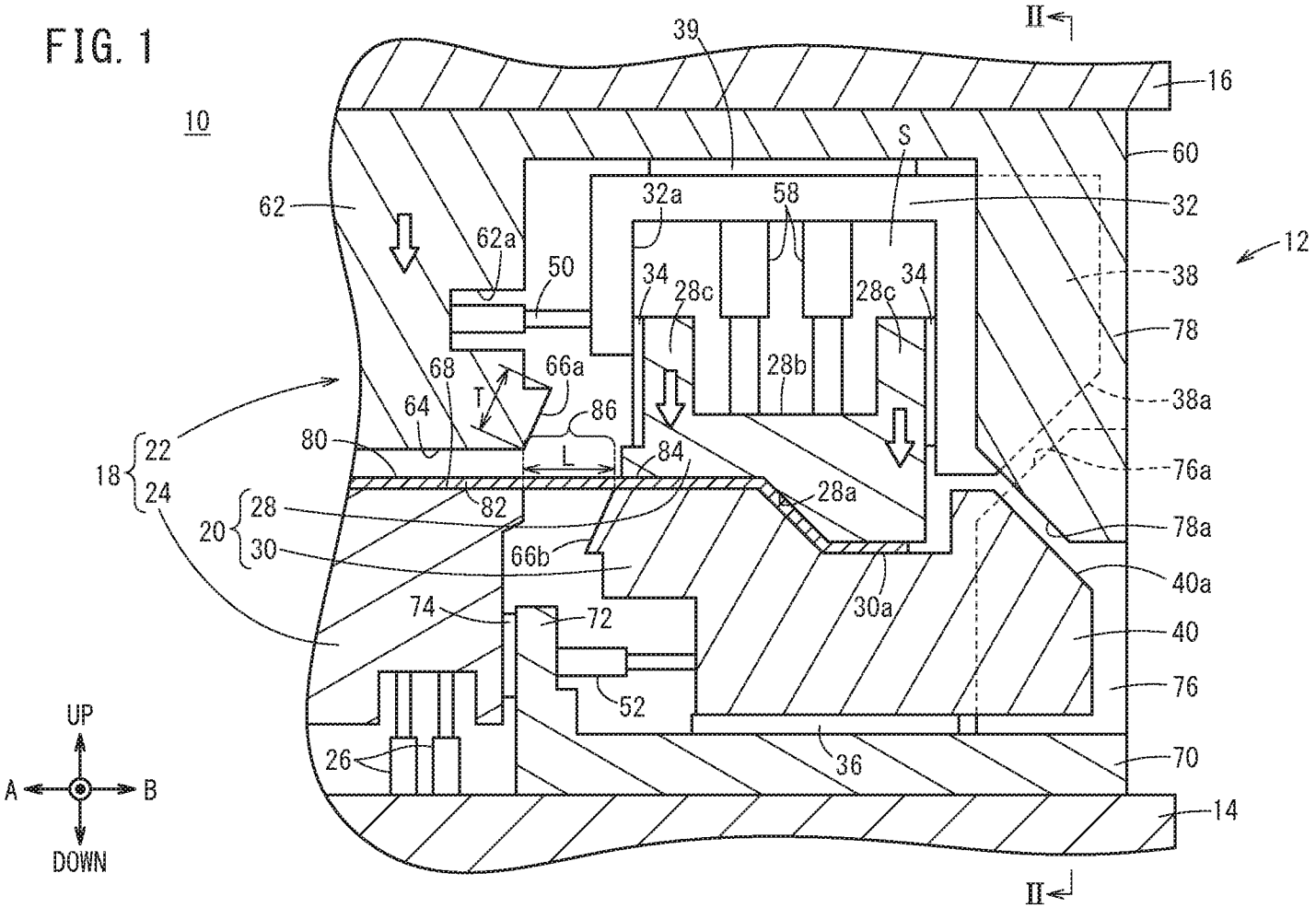
FIG. 1 is a cross-sectional view of a bending apparatus for use with a bending method according to an embodiment of the present invention (the cross section of FIG. 1 corresponds to the cross section at the part indicated by line I-I in FIG. 2)

As shown in FIG. 1, a bending apparatus 10 functions by placing a plate-shaped workpiece 80 in a die 12 and clamping the workpiece 80 with the die 12 to shape it into a stepped cross-section structure with a first face and a second face connected via a upright wall portion 88. The die 12 is positioned between a base 14 and a pressing unit 16, which constitute a pressing device, and is structured such that its components operate in response to a depressing displacement of the pressing unit 16.

The die 12 has a first-face forming die 18 that holds a first-face forming portion 82 of the workpiece 80 from above and below, and a second-face forming die 20 that holds a second-face forming portion 84 of the workpiece 80 from above and below. An intermediate portion 86 exists between the first-face forming portion 82 and the second-face forming portion 84 of the workpiece 80. The intermediate portion 86 is a portion that will be the upright wall portion 88 after shaping. Before shaping, the first-face forming die 18 and the second-face forming die 20 are spaced apart from each other by the length L of the intermediate portion 86. The length of the intermediate portion 86 is set as appropriate depending on the stroke of a cam described later and may be any length equal to or shorter than the length of the upright wall portion 88.

The first-face forming die 18 is displaced downward along with depressing operation of the pressing unit 16 in a downward direction (a first direction). The second-face forming die 20 moves in the direction of arrow A in FIG. 1 (a second direction) so as to approach the first-face forming die 18 upon a depressing operation of the pressing unit 16.

The components of the die 12 are now described in further detail. The die 12 has the first-face forming die 18, the second-face forming die 20, a first elastic mechanism 26 that deforms when the first-face forming die 18 is moved in the first direction by the pressing by the pressing unit 16 (a first driving unit), cam units 38, 40 (a second driving unit) that move the second-face forming die 20 in the second direction, and a second elastic mechanism 58 positioned above the second-face forming die 20 for absorbing the displacement of the pressing unit 16.

The first-face forming die 18 has a first-face upper die 22 (also called upper die 22) and a first-face lower die 24 (also called lower die 24).

The first-face upper die 22 is formed integrally with a fixed upper die 60 and has a post 62 extending downward from the fixed upper die 60. The fixed upper die 60 is a portion that operates integrally with the pressing unit 16 (the first driving unit) and the first-face upper die 22 is also displaced downward (in the first direction) along with the lowering of the pressing unit 16. At a lower end of the side face of the post 62 on the side of the second-face forming die 20 (on the side of the direction of arrow B), an upright-wall forming face 66*a* has been formed by cutting away a part of the post 62 at a certain angle. The upright-wall forming face 66*a* is a surface against which the second-face forming die 20 is pressed via the workpiece 80, and shaping of the upright wall portion 88 (see FIG. 5) takes place on this upright-wall forming face 66*a*. The width T of the upright-wall forming face 66*a* is sized to be equal to the length of the upright wall portion 88.

A die face 64 is formed at the lower end of the post 62. The die face 64 is a face that presses against the upper surface of the first-face forming portion 82 of the workpiece 80 and is formed in a predetermined uneven geometry. In the post 62, a notch 62*a* for mounting a pushback mechanism 50 discussed later may be formed.

Below the first-face upper die 22, the first-face lower die 24 is positioned. A die face 68 opposed to the die face 64 is formed at the upper end of the first-face lower die 24. The first-face lower die 24 abuts against the lower surface of the first-face forming portion 82 of the workpiece 80 at the die face 68. The die face 68 is formed in a shape corresponding to the die face 64.

The first-face lower die 24 is slidably in contact with a wall 72 of a fixed lower die 70 set on the base 14, via a slide plate 74. The first-face lower die 24 is mounted on the wall 72 of the fixed lower die 70 via a guide member not depicted and is movable in the vertical direction by being guided by the guide member. Below the first-face lower die 24, the first elastic mechanism 26 is positioned.

The first elastic mechanism 26 elastically compresses when the first-face lower die 24 is pressed with force exceeding a predetermined force along with the lowering of the pressing unit 16, which in turn causes the first-face lower die 24 to be displaced downward (in the first direction). The first elastic mechanism 26 may be a gas spring, for example. If necessary, the first elastic mechanism 26 may be equipped with a locking mechanism capable of maintaining its elastically compressed state.

Meanwhile, the second-face forming die 20 has a cam pad 28 and a lower slider 30. The cam pad 28 is a upper die for the second face to press the second-face forming portion 84 of the workpiece 80 from the top side, and abuts against the upper surface of the workpiece 80 at a die face 28*a* formed at the lower end. The die face 28*a* may be formed in a predetermined uneven geometry as shown in FIG. 1 corresponding to the three-dimensional shape to be formed on the second face. A recess 28*b* is formed in an upper portion of the cam pad 28, with the second elastic mechanism 58 mounted in the recess 28*b*. Load from the pressing unit 16 is transmitted to the cam pad 28 through the second elastic mechanism 58.

At the ends of the cam pad 28 on the side of direction of arrow A as well as on the side of direction of arrow B, transmitting portions 28*c* for transmitting the displacement of an upper slider 32 described later to the cam pad 28 are formed. The transmitting portions 28*c* are in contact with the upper slider 32 via slide plates 34.

The slide plates 34 are plate-shaped members that contain lubricating oil and transmit load in the direction perpendicular to their principal surfaces without changing it but reduce frictional force in the direction parallel to the principal surfaces. Via the slide plates 34, the cam pad 28 is held such that it can slide in the vertical direction with respect to the upper slider 32.

The upper slider 32 is positioned so as to cover the cam pad 28 from above and has a recess 32*a* housing the second elastic mechanism 58 therein. The recess 32*a* of the upper slider 32 and the recess 28*b* of the cam pad 28 form a displacement absorbing space S, in which the second elastic mechanism 58 is disposed. The second elastic mechanism 58 is a gas spring similar to the first elastic mechanism 26 and transmits load from the pressing unit 16 to the cam pad 28 while absorbing displacement resulting from the depression of the pressing unit 16. This maintains the cam pad 28 at a predetermined height even when the pressing unit 16 is depressed. The second elastic mechanism 58 is equipped with a locking mechanism capable of maintaining its elastically compressed state.

The upper slider 32 is in contact with the fixed upper die 60 via a slide plate 39. The slide plate 39 is a member similar to the slide plates 34. This allows the upper slider 32 to slide in the directions of arrows A and B with respect to the fixed upper die 60.

Below the cam pad 28, the lower slider 30 serving as the lower die of the second-face forming die 20 is provided. The upper end of the lower slider 30 is a die face 30*a*, which is formed in a shape corresponding to the die face 28*a* of the cam pad 28. At the die face 30*a*, the lower slider 30 abuts against the lower surface of the second-face forming portion 84. At the end of the lower slider 30 in the direction of arrow A, an upright-wall forming face 66*b* has been formed by cutting away part of a side face of the lower slider 30. The upright-wall forming face 66*b* lies opposed to the upright-wall forming face 66*a* across the intermediate portion 86 during the shaping step on the workpiece 80 and presses the intermediate portion 86. The upright-wall forming face 66*b* is formed with the same width as that of the upright-wall forming face 66*a*.

The lower slider 30 is supported by the fixed lower die 70 via the slide plate 36. The slide plate 36 is a member similar to the slide plates 34, allowing the lower slider 30 to slide in the directions of arrows A and B with respect to the fixed lower die 70.

The cam pad 28 and the lower slider 30 described above are driven in the direction of arrow A, that is, the second direction, by a cam mechanism (the second driving unit). The cam mechanism is divided into one for driving for the cam pad 28 side and one for driving the lower slider 30 side.

The cam mechanism for driving the cam pad 28 has the cam unit 38 provided in the upper slider 32 and a cam driver 76 that makes sliding contact with the cam unit 38. The cam unit 38 is formed integrally with the upper slider 32 and has a cam face 38*a* formed at the lower end thereof. The cam face 38*a* of the upper slider 32 is inclined such that its lower end is closer to the side of the upper die 22 and the lower die 24 (the side of the direction of arrow A) than the upper end is. The cam driver 76 is a columnar portion extending upward from the fixed lower die 70 and has a cam face 76*a* at the upper end thereof. The cam face 76*a* of the cam driver 76 is formed as an inclined surface parallel with the cam face 38*a*.

The cam face 38*a* slides while being pressed against the cam face 76*a* of the cam driver 76 upon a downward displacement of the upper slider 32 resulting from a depressing operation of the pressing unit 16. This causes the upper slider 32 to move in the direction of arrow A (the second direction). That is, the cam face 38*a* converts the displacement of the pressing unit 16 in the downward direction (the first direction) into displacement in the direction of arrow A (the second direction) of the upper slider 32.

Meanwhile, the cam mechanism for driving the lower slider 30 has the cam unit 40 provided in the lower slider 30 and a cam driver 78 that makes sliding contact with the cam unit 40. The cam unit 40 of the lower slider 30 has a cam face 40*a* at the upper end thereof. The cam face 40*a* is inclined in an orientation such that its upper end is closer to the side of the upper die 22 and the lower die 24 (the side of the direction of arrow A) than the lower end is. The cam driver 78 is a columnar portion extending downward from the fixed upper die 60 and has a cam face 78*a* at the lower end thereof. The cam face 78*a* of the cam driver 78 is formed as an inclined surface parallel with the cam face 40*a* of the lower slider 30.

The cam driver 78 lowers integrally with the pressing unit 16, and the cam face 78*a* of the cam driver 78 presses against the cam face 40*a* of the lower slider 30. This causes the cam face 40*a* of the lower slider 30 to slide and the lower slider 30 moves in the direction of arrow A (the second direction).

Figure 2:
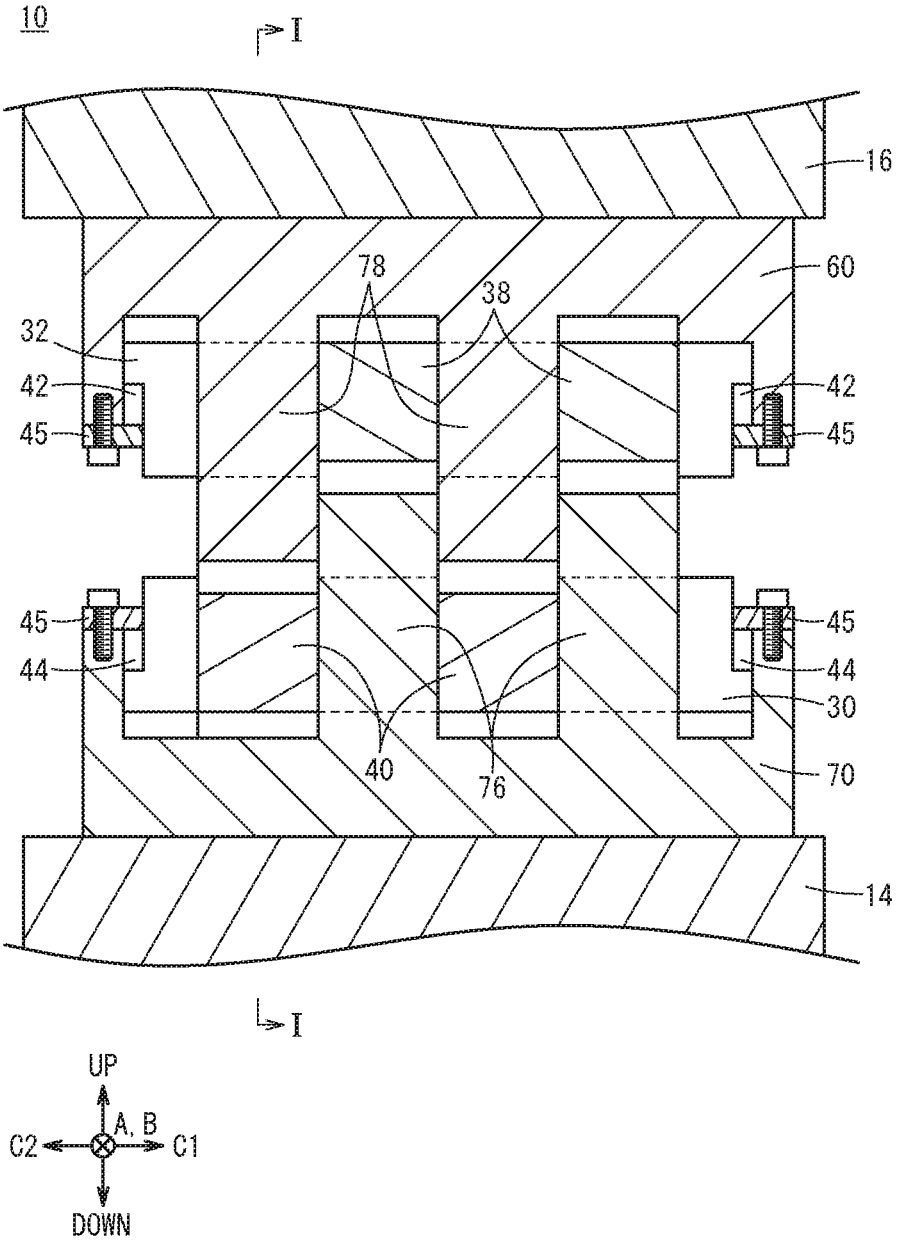
FIG. 2 is a cross-sectional view taken along line II-II in FIG. 1.

As shown in FIG. 2, the cam driver 76 for driving the cam pad 28 and the cam driver 78 for driving the lower slider 30 are staggered in the direction of arrow C. The cam unit 40 of the lower slider 30 and the cam unit 38 of the upper slider 32 are positioned between these cam drivers 76, 78.

As shown in FIG. 2, a guide rail 42 for guiding the upper slider 32 is provided beside the fixed upper die 60 and a guide rail 44 for guiding the lower slider 30 is provided beside the fixed lower die 70. The guide rails 42, 44 extend in the directions of arrows A and B (the direction perpendicular to the page) and the lower slider 30 and the upper slider 32 move by being guided in the directions of arrows A and B. The guide rails 42, 44 are covered by keeper plates 45 and fixed to the fixed upper die 60 and the fixed lower die 70, respectively. The upper slider 32 and the lower slider 30 are thus secured without wobbling.

Also, as shown in FIG. 1, the upper slider 32 and the lower slider 30 have pushback mechanisms 50, 52 mounted thereon for biasing the upper slider 32 and the lower slider 30 in the direction away from the upper die 22 and from the lower die 24 (in the direction of arrow B) and pushing a displacement in the direction of arrow A (the second direction) caused by the cam mechanism back to the initial position. The pushback mechanism 50 is provided between the notch 62*a* of the first-face upper die 22 and the upper slider 32. The pushback mechanism 52 is provided between the wall 72 of the fixed lower die 70 and the lower slider 30.

These pushback mechanisms 50, 52 elastically compress with the movement of the upper slider 32 and the lower slider 30 in the direction of arrow A (the second direction) caused by the cam mechanism. When the pressing by the cam mechanism is released, the pushback mechanisms 50, 52 push back the upper slider 32 in the direction of arrow B with elastic biasing force. The pushback mechanisms 50, 52 may be gas springs similar to the first and second elastic mechanisms 26, 58. The pushback mechanisms 50, 52 are equipped with locking mechanisms.

With the bending apparatus 10 according to this embodiment configured as described above, a bending method using the bending apparatus 10 is practiced as described below.

To start with, a plate-shaped workpiece 80 cut into a predetermined shape is prepared and placed in the die 12 of the bending apparatus 10 with the die 12 being fully open.

The pressing unit 16 is then depressed. This pushes down the cam pad 28 and the first-face upper die 22. Then, as shown in FIG. 1, the second-face forming portion 84 of the workpiece 80 is held by being clamped by the cam pad 28 and the lower slider 30 from above and below. Further, by the transmission of load from the pressing unit 16 to the cam pad 28 via the fixed upper die 60, the slide plate 39, the upper slider 32 and the second elastic mechanism 58, the cam pad 28 is pressed against the lower slider 30 to shape the second-face forming portion 84 into a predetermined three-dimensional shape.

As the pressing unit 16 is further lowered, the fixed upper die 60 is pushed down. In response, the second elastic mechanism 58 on the cam pad 28 elastically compresses and the upper slider 32 approaches the cam pad 28 while sliding with the slide plates 34. In this manner, the displacement of the pressing unit 16 relative to the cam pad 28 is absorbed by the second elastic mechanism 58, and thus the vertical position of the cam pad 28 remains unchanged.

Figure 3:
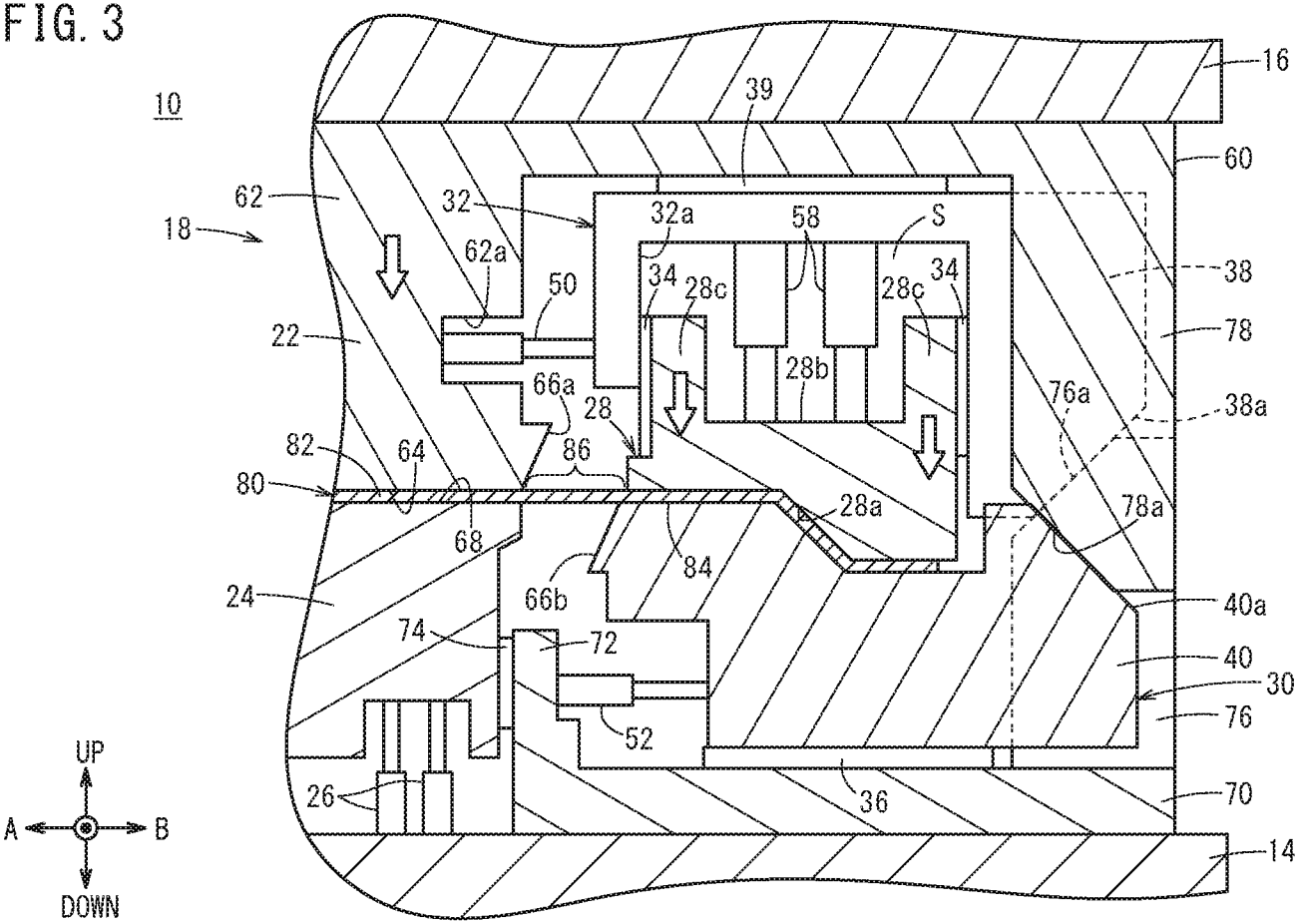
FIG. 3 is a cross-sectional view showing a work holding step of the bending method according to the embodiment of the present invention.

Meanwhile, the first-face upper die 22, integrally formed with the fixed upper die 60, lowers with the fixed upper die 60, and the first-face upper die 22 presses against the first-face forming portion 82 of the workpiece 80 from above as shown in FIG. 3. This results in the first-face forming portion 82 and the second-face forming portion 84 of the workpiece 80 being clamped by the first-face forming die 18 and the second-face forming die 20, respectively, thus completing a workpiece holding step.

When the workpiece 80 is in a state of being held by the first-face forming die 18 and the second-face forming die 20, the cam face 40*a* of the lower slider 30 comes into contact with the cam face 78*a* of the cam driver 78 and the cam face 38*a* of the upper slider 32 comes into contact with the cam face 76*a* of the cam driver 76.

Figure 4:
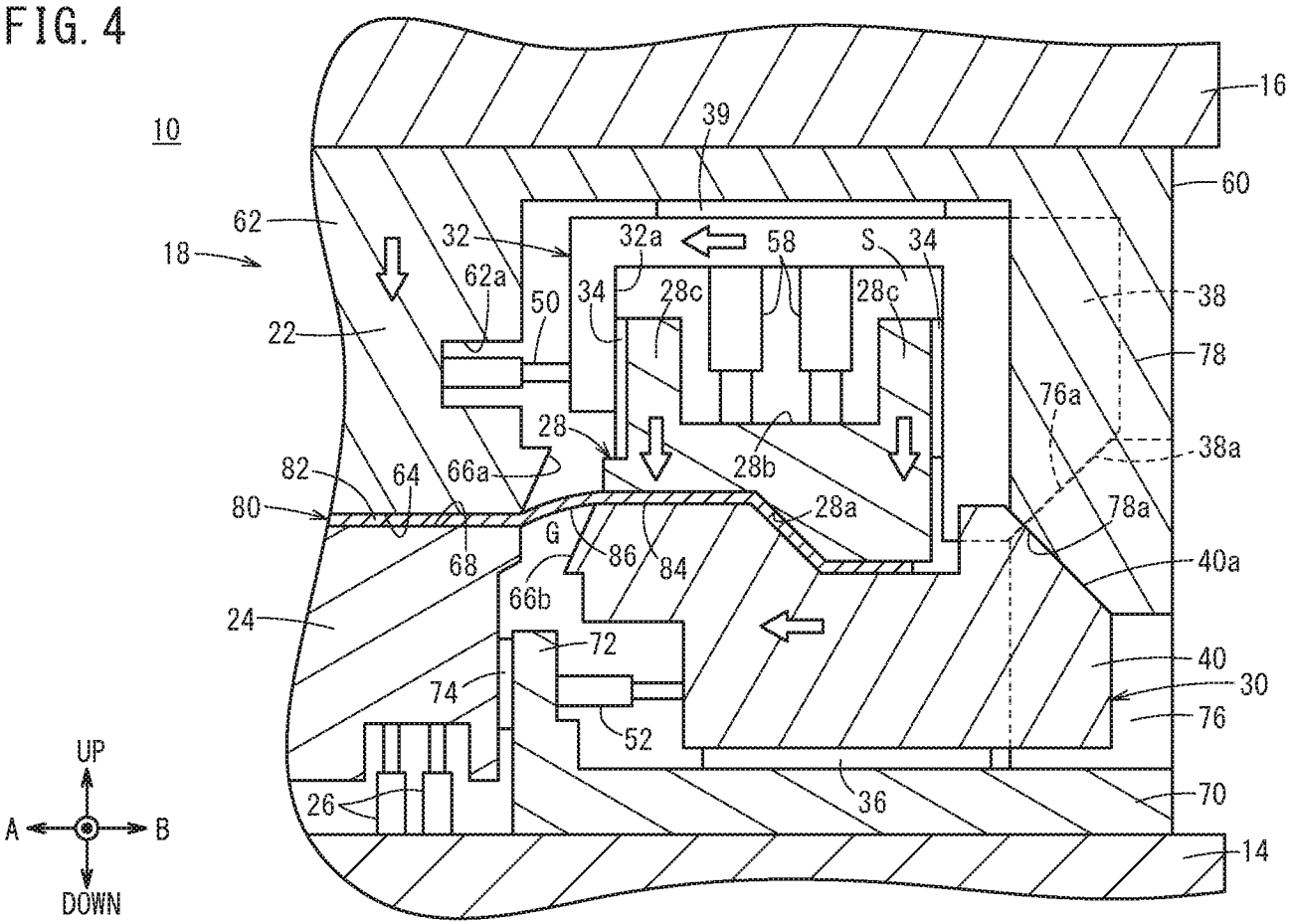
FIG. 4 is a cross-sectional view (part 1) showing a shaping step of the bending method according to the embodiment of the present invention.

As shown in FIG. 4, when the pressing unit 16 further lowers, the cam driver 78 lowers and the cam face 40*a* of the lower slider 30 is pressed by the cam face 78*a* of the cam driver 78. This causes the cam face 40*a* of the lower slider 30 to slide and the lower slider 30 moves in the direction of arrow A (the second direction). Also, as the upper slider 32 moves downward along with the lowering of the pressing unit 16, the cam face 38*a* slides while being pressed against the cam face 76*a* of the cam driver 76. This causes the upper slider 32 to move in the direction of arrow A (the second direction). The cam pad 28 moves in the direction of arrow A with the upper slider 32. In this manner, the cam pad 28 and the lower slider 30 constituting the second-face forming die 20 move in the second direction.

Meanwhile, the first-face upper die 22 presses the first-face lower die 24 downward along with the lowering of the pressing unit 16. As a result, the first-face upper die 22 and the first-face lower die 24 move downward, with the first elastic mechanism 26 supporting the first-face lower die 24 being elastically compressed. In this manner, the first-face forming die 18 moves downward (in the first direction) and the second-face forming die 20 moves in the direction of arrow A (the second direction).

As the first-face forming die 18 and the second-face forming die 20 move as described above, the intermediate portion 86 of the workpiece 80 gradually deforms such that it rises up. The intermediate portion 86 deforms in a state of being suspended in a gap G between the first-face forming die 18 and the second-face forming die 20. During the deformation, no bending and/or ironing is applied to the intermediate portion 86 and thus the workpiece 80 deforms with no processing history added to the intermediate portion 86.

Figure 5:
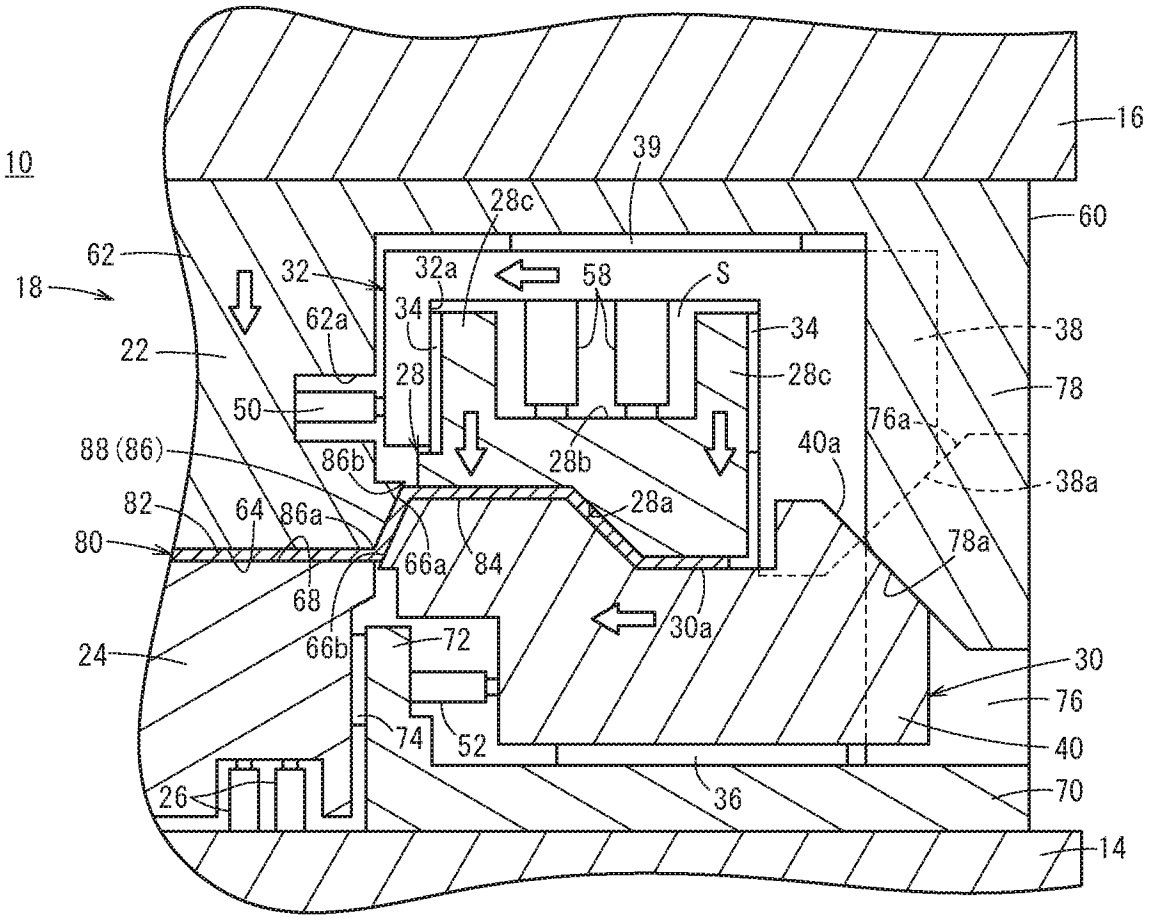
FIG. 5 is a cross-sectional view (part 2) showing the shaping step of the bending method according to the embodiment of the present invention.

After that, the bottom dead center of the bending apparatus 10 is reached and the lowering of the pressing unit 16 stops as shown in FIG. 5. At this point, the intermediate portion 86 is pressed while being clamped between the upright-wall forming face 66*b* of the lower slider 30 and the upright-wall forming face 66*a* of the first-face upper die 22. The upper and lower ends of the intermediate portion 86 are thus bent such that folded parts 86*a*, 86*b* are formed, shaping the workpiece 80 into a cross-sectional shape with the intermediate portion 86 raised like a step. This means that the intermediate portion 86 has been shaped into the upright wall portion 88 raised like a step.

The shaping step is thus completed.

Figure 6:
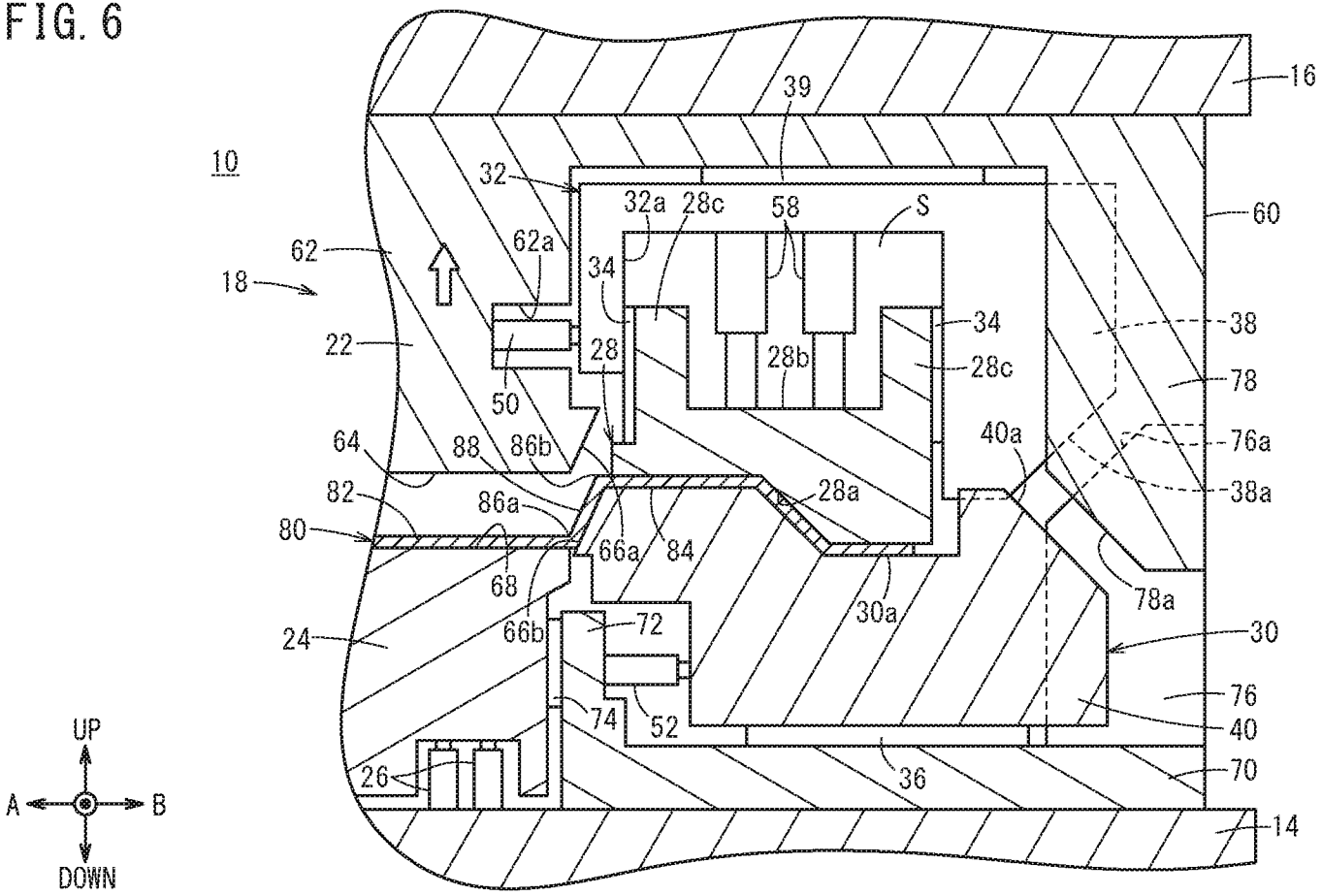
FIG. 6 is a cross-sectional view showing a die opening step of the bending method according to the embodiment of the present invention.

Next, a die opening step for the first-face forming die 18 and the second-face forming die 20 is performed as shown in FIG. 6. It starts by keeping the second elastic mechanism 58 and the pushback mechanisms 50, 52 in a compressed state at the bottom dead center by means of their locking mechanisms. This keeps the positions of the upper and lower sliders 32, 30 in the first direction fixed at the bottom dead center. Thereafter, the pressing unit 16 is lifted to separate the cam pad 28 from the lower slider 30 and further separate the first-face upper die 22 from the first-face lower die 24. After that, the locking mechanisms of the pushback mechanisms 50, 52 and that of the second elastic mechanism 58 are released sequentially to return the cam pad 28 and the upper and lower sliders 32, 30 to their initial positions, thus completing the die opening step.

This completes the bending method according to this embodiment. The bending method and bending apparatus 10 described above provide the following effects.

The intermediate portion 86 is suspended off the first-face forming die 18 and the second-face forming die 20 during movement of the first-face forming die 18 and the second-face forming die 20, which can restrain bending and/or ironing from being applied to the intermediate portion 86. That is, bending is only applied to the folded parts 86*a*, 86*b* located at the opposite ends of the upright wall portion 88 and no bending and/or ironing is applied to the other portions. Thus, residual stress in the upright wall portion 88 can be reduced and warping of the upright wall portion 88 can be prevented.

The cam drivers 76, 78 and the cam faces 38*a*, 40*a* which make sliding contact with the cam drivers 76, 78 convert the displacement of the pressing unit 16 in the first direction into displacement in the second direction so as to move the second-face forming die 20 in the second direction. Thus, it is possible to press the second-face forming die 20 with a pressing device common with the first-face forming die 18. That is, the second-face forming die 20 can be moved in the second direction with a simple device configuration.

The second elastic mechanism 58 is provided in the displacement absorbing space S between the cam pad 28 and the upper slider 32 so that displacement of the first-face forming die 18 is absorbed by the second elastic mechanism 58. This can move the second-face forming die 20 only in the second direction without causing its displacement in the first direction even when the first-face forming die 18 and the second-face forming die 20 are pressed with the common pressing device.

Next, variations of the bending method and the bending apparatus 10 according to the above embodiment are described.

Figure 7:
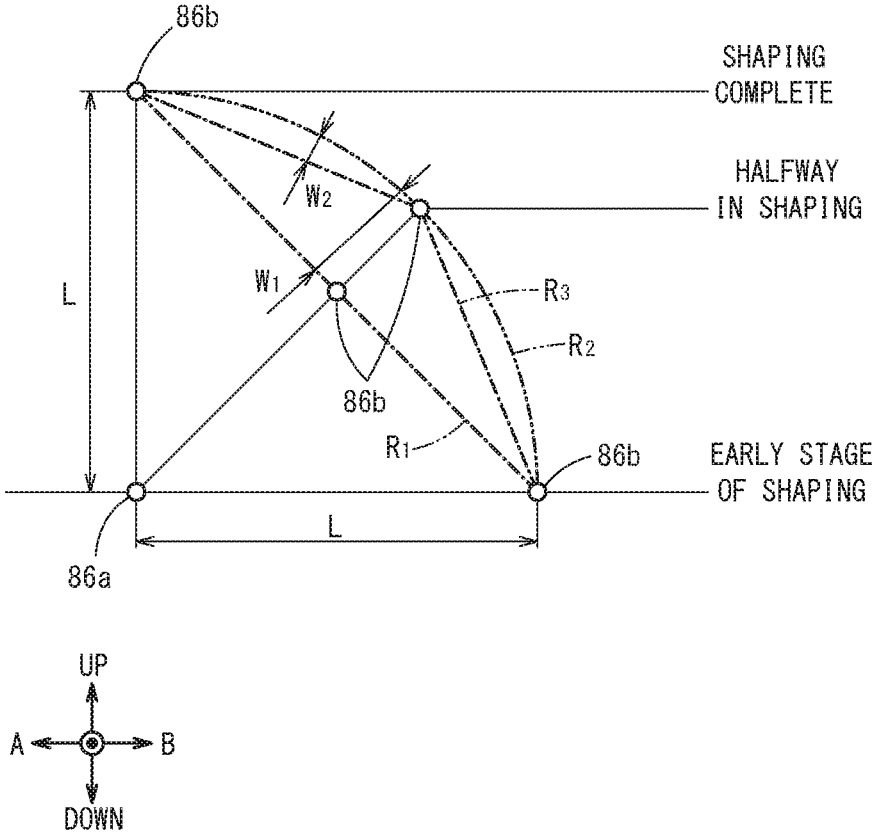
FIG. 7 is a schematic illustration showing the displacement of a folded part of an upright wall portion during the shaping step of FIGS. 4 and 5.

The displacements of the folded parts 86*a*, 86*b* of the intermediate portion 86 during the shaping step of FIGS. 4 and 5 are represented as shown in FIG. 7, with the folded part 86*a* of the upright wall portion 88 on the first-face side being the reference. Considered as an example is a case where the cam face 38*a* of the upper slider 32 and the cam face 40*a* of the lower slider 30 are each configured as a single inclined surface as shown in FIG. 1.

In this case, from an early stage through a late stage of the shaping step, the rate of the displacement of the upper and lower sliders 32, 30 relative to the downward displacement of the first-face forming die 18 is constant, corresponding to the inclination of the cam faces 38*a*, 40*a*. Accordingly, one folded part 86*b* of the intermediate portion 86 moves relative to the other folded part 86*a* along a path $R_1$ that connects the position in an early stage of shaping and the position at the completion of shaping with a line segment, as shown in FIG. 7. In this case, an excess equivalent to length $W_1$ occurs in the intermediate portion 86 halfway in the shaping step.

Figure 8:
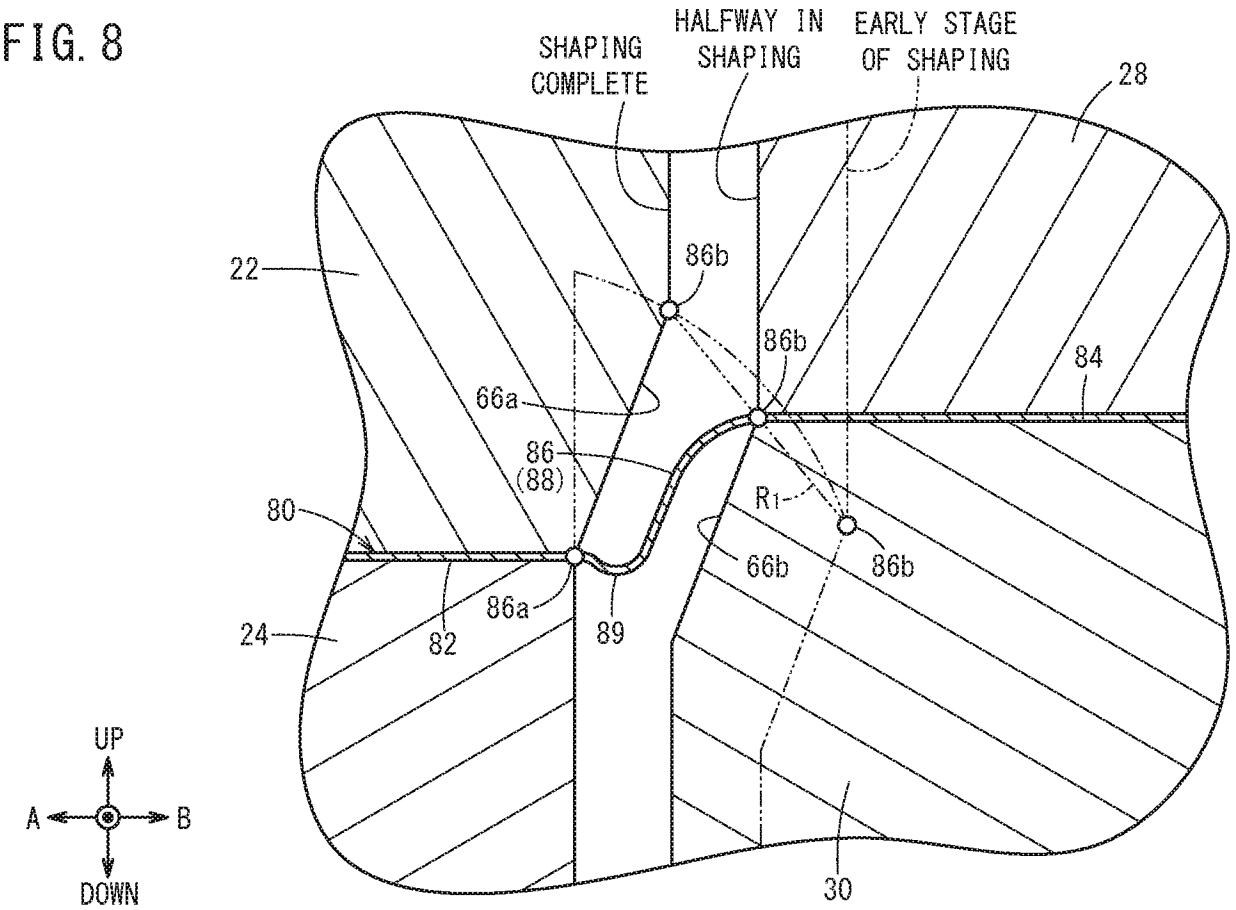
FIG. 8 is a schematic illustration showing an excess occurring in the upright wall portion during the shaping step.

This excess length of the intermediate portion 86 gives rise to a corrugated portion 89 in the upright wall portion 88 as shown in FIG. 8, and bending is applied to a portion of the upright wall portion 88 that does not require processing. This can result in wrinkles and/or strain around the upright wall portion 88.

Figure 9A:
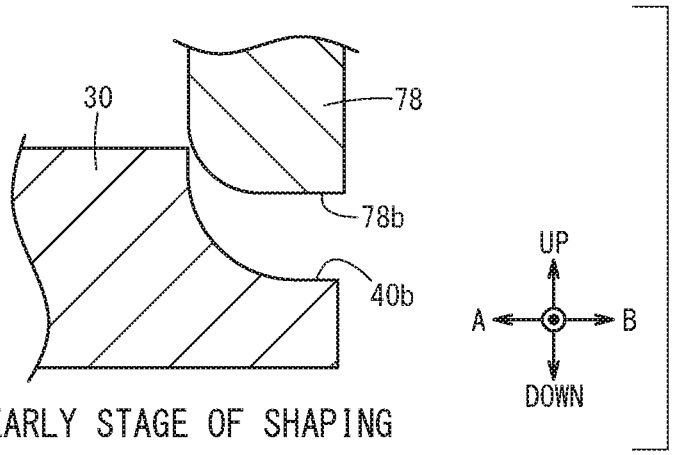
FIGS. 9A, 9B and 9C are cross-sectional views showing a first variation of a cam mechanism of the bending apparatus of FIG. 1.
Figure 9B:
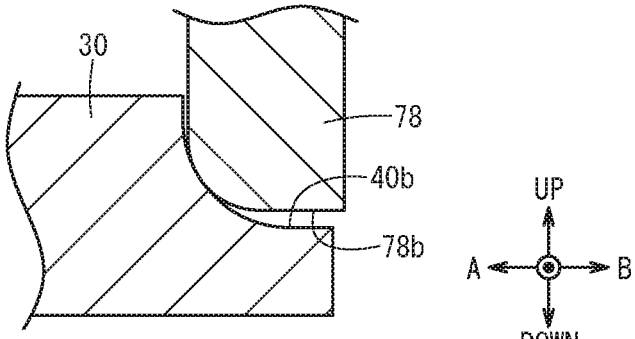
Figure 9C:
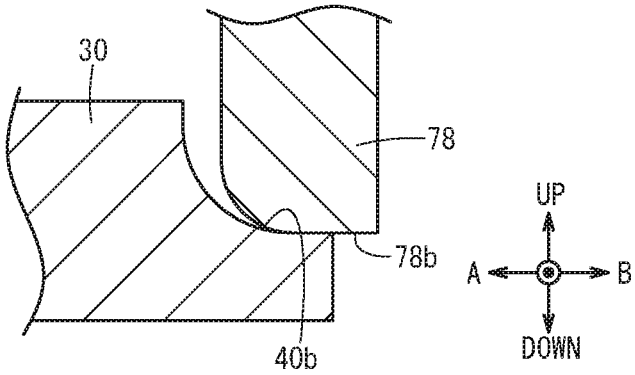

Accordingly, in a first variation shown in FIGS. 9A to 9C, a cam face 40*b* of the lower slider 30 is made as a curved surface. In this case, the cam face 78*b* of the cam driver 78 will also be a curved surface. Although FIGS. 9A to 9C show only the cam face 40*b* of the lower slider 30 and the cam driver 78, the upper slider 32 side may be similarly configured.

As shown in FIG. 9A, a portion of the cam face 40*b* in contact with the cam driver 78 in an early stage of shaping is formed with a large gradient. Also, as shown in FIGS. 9B and 9C, the portions which are contacted by the cam driver 78 toward a late stage of shaping have gradually smaller gradients. When the gradient of the cam face 40*b* is large, the amount of movement of the lower slider 30 relative to the amount of depression of the pressing unit 16 is small. That is, the movement speed of the second-face forming die 20 in the second direction in an early stage of the shaping step is low. As the gradient of the portion in contact with the cam driver 78 is decreased in a late stage of shaping, the amount of movement of the lower slider 30 in the second direction relative to the amount of depression of the pressing unit 16 increases. That is, in a late stage of shaping, the movement speed of the second-face forming die 20 in the second direction changes such that it is higher than the depression speed of the pressing unit 16.

Consequently, the folded part 86*b* of the intermediate portion 86 moves along a path $R_2$ that runs along an arc centered at the folded part 86*a* and having a radius equal to the length of the intermediate portion 86 as shown in FIG. 7, which prevents the occurrence of an excess length of the intermediate portion 86 during the shaping step. As a result, wrinkles and/or strain around the upright wall portion 88 of the workpiece 80 can be prevented.

Figure 10A:
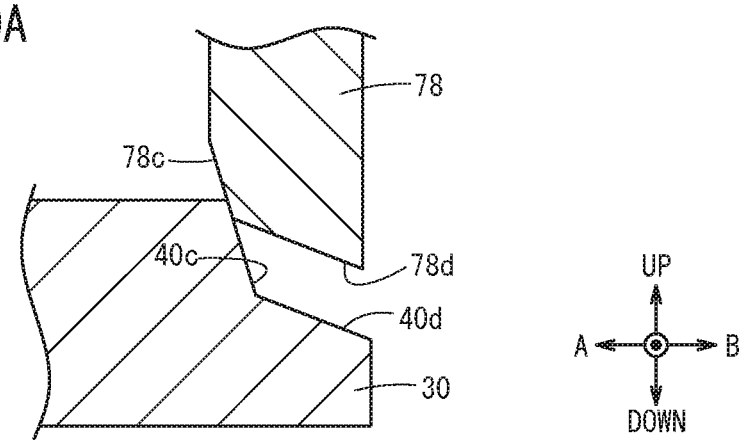
FIGS. 10A, 10B and 10C are cross-sectional views showing a second variation of the cam mechanism of the bending apparatus of FIG. 1.
Figure 10B:
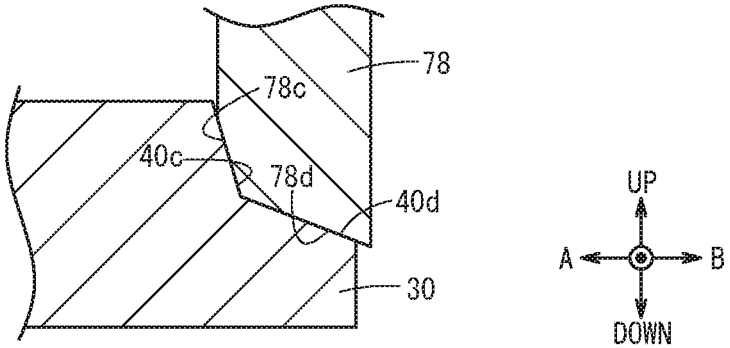
Figure 10C:
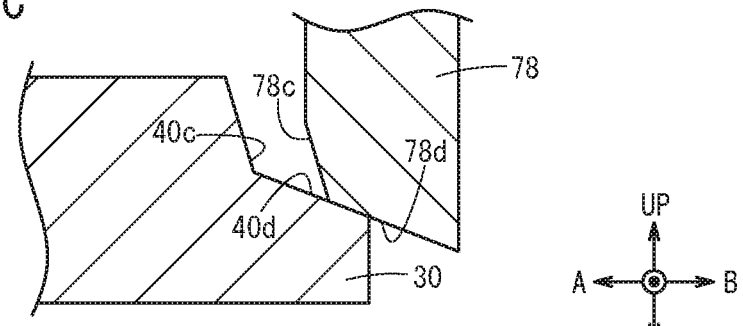

Alternatively, like a second variation shown in FIGS. 10A to 10C, the cam face of the lower slider 30 may be composed of multiple inclined surfaces 40*c*, 40*d*. In this case, the cam driver 78 is also provided with two inclined surfaces 78*c*, 78*d* parallel with the inclined surfaces 40*c*, 40*d* of the lower slider 30. Although FIGS. 10A to 10C show only the lower slider 30, the upper slider 32 may be similarly configured.

As shown in FIG. 10A, in an early stage of shaping, the inclined surface 78*c* of the cam driver 78 makes planar contact with the inclined surface 40*c* having a larger gradient and the lower slider 30 slides relative to the cam driver 78 on the inclined surface 40*c*. This makes the amount of movement of the lower slider 30 small relative to the amount of depression of the pressing unit 16 in an early stage of the shaping step.

Further, when the cam driver 78 is pushed down, the inclined surface 78*d* of the cam driver 78 makes planar contact with the inclined surface 40*d* of the lower slider 30 halfway in the shaping step as shown in FIG. 10B. Subsequently, the inclined surface 40*d* of the lower slider 30 slides against the inclined surface 78*d* of the cam driver 78 as shown in FIG. 10C until the completion of the shaping step. Since the gradient of the inclined surface 40*d* is smaller than the gradient of the inclined surface 40*c*, the amount of movement of the lower slider 30 relative to the amount of depression of the pressing unit 16 becomes large. As a result, the movement speed of the lower slider 30 in the second direction in a late stage of the shaping step is higher than the movement speed of the lower slider 30 in an early stage of shaping.

When the cam face is composed of multiple inclined surfaces as in the second variation, the folded part 86*b* of the intermediate portion 86 moves along a path that connects in-between point(s) set on the arc centered at the folded part 86*a* and having a radius equal to the length of the intermediate portion 86 with a line segment, like a path $R_3$ in FIG. 7. In this case, the excess length of the intermediate portion 86 occurring in the shaping step will be $W_2$, which is shorter than that of the intermediate portion 86 in the case of taking the path $R_1$. Thus, the corrugated portion 89 of the intermediate portion 86 can be confined within an allowable range and wrinkles and/or strain around the upright wall portion 88 after shaping can be prevented.

Since the inclined surfaces 40*c*, 40*d* of the lower slider 30 make planar contact with the inclined surfaces 78*c*, 78*d* of the cam driver 78, the cam faces of the second variation are less likely to deform with abrasion and can prevent trouble associated with the abrasion of the cam units.

While the present invention has been described with reference to preferred embodiments, it will be appreciated that the present invention is not limited to those embodiments and various modifications are possible without departing from the scope of the present invention.

For example, although the above embodiment was described for a case where the second-face forming die is moved in the second direction using a cam and a cam driver as the second driving unit (the interlock mechanism), the cam mechanism described above may be replaced with a gear and a linkage as the interlock mechanism.

What is claimed is:

1. A bending method for bending a workpiece using a first-face forming die and a second-face forming die to shape the workpiece into a stepped cross-section structure with a first face and a second face connected via an upright wall portion, the bending method comprising:

a step of preparing the workpiece;

a workpiece holding step of clamping a first-face forming portion of the workpiece and a second-face forming portion spaced apart from the first-face forming portion by a length of the upright wall portion, with the first-face forming die and the second-face forming die, respectively; and a shaping step of moving the first-face forming die in a first direction perpendicular to a principal surface of the workpiece and moving the second-face forming die in a second direction parallel with the principal surface of the workpiece, and pressing the second-face forming die against the first-face forming die to shape the upright wall portion, wherein the first-face forming die has an upper die to be displaced integrally with a first drive, a lower die to be pressed by the upper die, and a first gas cushion which supports the lower die, and elastically compresses upon pressing by the first drive and the second-face forming die has an upper slider for transmitting load from the first drive, a lower slider opposed to the upper slider, and a second gas cushion which biases the lower slider in a direction opposite to the second direction.

2. The bending method according to claim 1, wherein in an early stage of the shaping step, a movement speed of the second-face forming die in the second direction is lower than a movement speed of the first-face forming die in the first direction, and in a late stage of the shaping step, the movement speed of the second-face forming die in the second direction is higher than the movement speed of the first-face forming die in the first direction.

3. The bending method according to claim 2, wherein the movement speed of the second-face forming die in the shaping step is gradually increased.

4. The bending method according to claim 2, wherein the movement speed of the second-face forming die in the shaping step is increased stepwise.

5. The bending method according to claim 1, wherein in the shaping step, a position of an end of the upright wall portion on a first-face side in a cross section of the workpiece moves along an arc centered at an end of the upright wall portion on a second-face side and having a radius equal to the length of the upright wall portion.

6. The bending method according to claim 1, wherein in the shaping step, a position of an end of the upright wall portion on a first-face side in a cross section of the workpiece moves on a path that connects, with a line segment, one or more in-between points set on an arc centered at an end of the upright wall portion on a second-face side and having a radius equal to the length of the upright wall portion.

7. The bending method according to claim 1, further comprising:

a die opening step of opening the first-face forming die and the second-face forming die and removing the workpiece, wherein in the die opening step, the first-face forming die is opened before returning the second-face forming die.

8. A bending apparatus for bending a workpiece using a first-face forming die and a second-face forming die to shape the workpiece into a stepped cross-section structure with a first face and a second face connected via an upright wall portion, the bending apparatus comprising:

the first-face forming die to clamp a first-face forming portion of the workpiece;

the second-face forming die to clamp a second-face forming portion spaced apart from the first-face forming portion by a length of the upright wall portion, a first drive for moving the first-face forming die moves in a first direction perpendicular to a principal surface of the workpiece; and a second driving unit for moving the second-face forming die in a second direction parallel with the principal surface of the workpiece to press the second-face forming die against the first-face forming die, wherein the first-face forming die has an upper die to be displaced integrally with the first drive, a lower die to be pressed by the upper die, and a first gas cushion which supports the lower die, and elastically compresses upon pressing by the first drive and the second-face forming die has an upper slider for transmitting load from the first drive, a lower slider opposed to the upper slider, and a second gas cushion which biases the lower slider in a direction opposite to the second direction.

9. The bending apparatus according to claim 8, wherein the second driving unit has an interlock mechanism for driving the second-face forming die in the second direction by means of a driving force of the first drive that also moves the first-face forming die in the first direction.

10. The bending apparatus according to claim 9, wherein the interlock mechanism has a cam driver for transmitting pressure in the first direction and a cam face formed on the second-face forming die and making sliding contact with the cam driver, and displacing the second-face forming die in the second direction upon pressing by the cam driver.

11. The bending apparatus according to claim 10, wherein the cam face of the second-face forming die is a curved surface, and a gradient of the cam face in a portion in contact with the cam driver in an early stage of shaping is larger than a gradient of the cam face in a portion in contact with the cam driver in a late stage of shaping.

12. The bending apparatus according to claim 10, wherein the cam face of the second-face forming die has a plurality of inclined surfaces with different gradients, and a gradient of an inclined surface in contact with the cam driver in an early stage of shaping is larger than a gradient of an inclined surface in contact with the cam driver in a late stage of shaping.

13. The bending apparatus according to claim 12, wherein the cam driver has a plurality of cam faces, wherein a number of cam faces of the cam driver is as many as a number of the inclined surfaces of the cam face, and the cam faces of the cam driver make planar contact with the inclined surfaces of the second-face forming die.

14. The bending apparatus according to claim 8, further comprising:

a second elastic mechanism that is mounted on the second-face forming die and elastically compresses in the first direction to inhibit displacement of the second-face forming die in the first direction.

15. The bending apparatus according to claim 8, further comprising:

a pushback mechanism for returning the second-face forming die to an initial position.

16. The bending apparatus according to claim 8, wherein the second gas cushion is capable of being locked and maintaining a compressed state of the second gas cushion, and the second gas cushion maintains the compressed state when the upper die of the first-face forming die is separated from the workpiece.

* * * * *